United States Patent [19]

Cruff et al.

[11] 4,114,285

[45] Sep. 19, 1978

[54] METHOD AND APPARATUS FOR DRYING INVESTMENT CASTING MOLDS

[75] Inventors: Carlton E. Cruff, Manchester, Conn.; William E. Harrison, Royal Oak, Mich.

[73] Assignee: United Technologies Corporation, Hartford, Conn.

[21] Appl. No.: 713,025

[22] Filed: Aug. 9, 1976

[51] Int. Cl.[2] ..... F26B 3/04

[52] U.S. Cl. ..... 34/29; 34/26; 34/28; 34/216; 34/217; 427/378

[58] Field of Search ..... 34/26, 28, 29, 31, 46, 34/48, 107, 210, 213, 214, 216, 217; 264/60, 65, 66; 427/372 A, 377, 378, 379, 380

[56] References Cited

U.S. PATENT DOCUMENTS

| | | | |
|---|---|---|---|
| 2,932,864 | 4/1960 | Mellen, Jr. et al. | 164/26 |
| 3,191,250 | 6/1965 | Mellen, Jr. et al. | 34/50 X |
| 3,850,224 | 11/1974 | Vidmar et al. | 164/4 |
| 4,064,639 | 12/1977 | Pels-Leusden et al. | 34/216 |

FOREIGN PATENT DOCUMENTS

| | | | |
|---|---|---|---|
| 520,191 | 4/1940 | United Kingdom | 34/26 |
| 727,216 | 3/1955 | United Kingdom | 34/210 |

*Primary Examiner*—William F. O'Dea
*Assistant Examiner*—Harold Joyce
*Attorney, Agent, or Firm*—Edward J. Timmer

[57] ABSTRACT

The method and apparatus of the present invention substantially reduce the incidence of cracking, flaking, bulging and other mold defects which originate during the drying step of the investment mold formation process. Drying is conducted under conditions which enhance uniformity of drying and which preclude harmful increases in pattern temperature resulting from changes in the moisture removal kinetics of the slurry layer. In particular, during the drying process, drying air of different quality is provided during the different stages of moisture removal from the slurry layer.

13 Claims, 10 Drawing Figures

FIG. 5
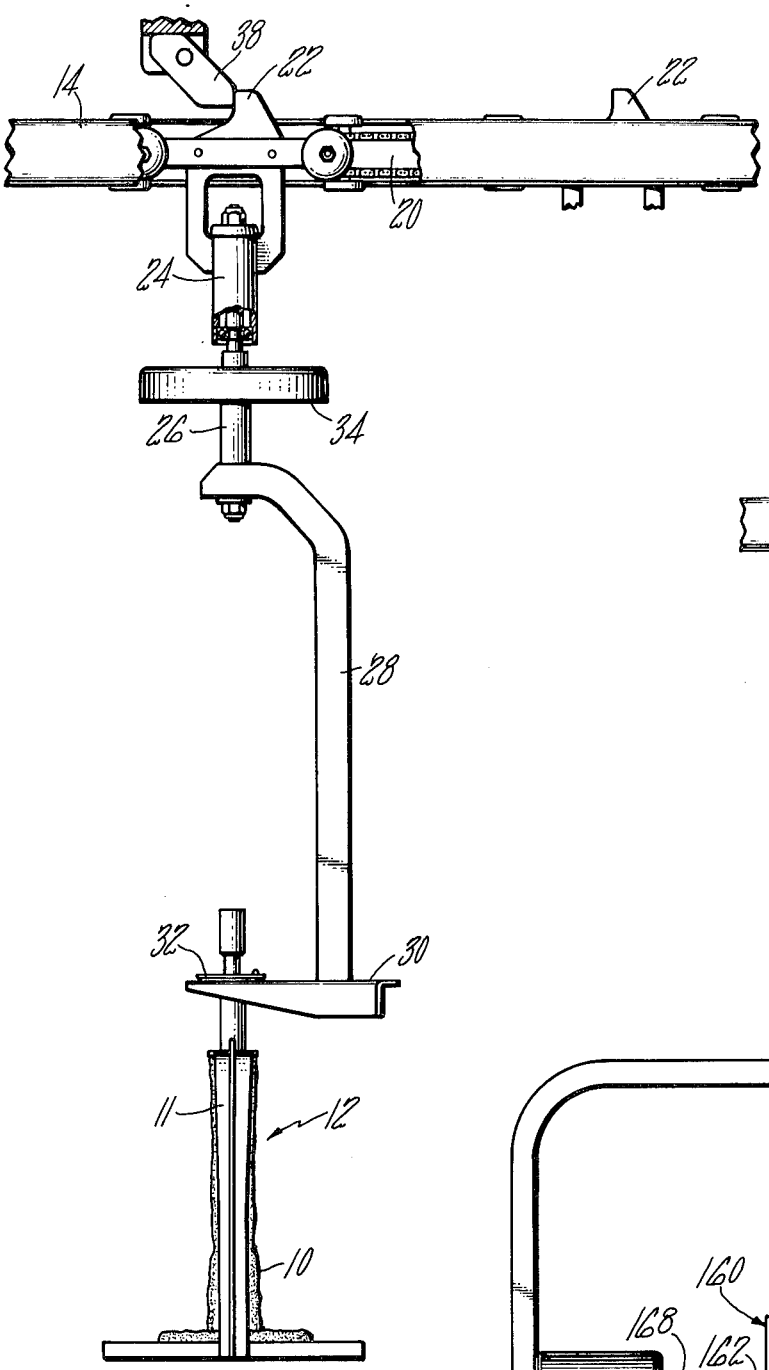
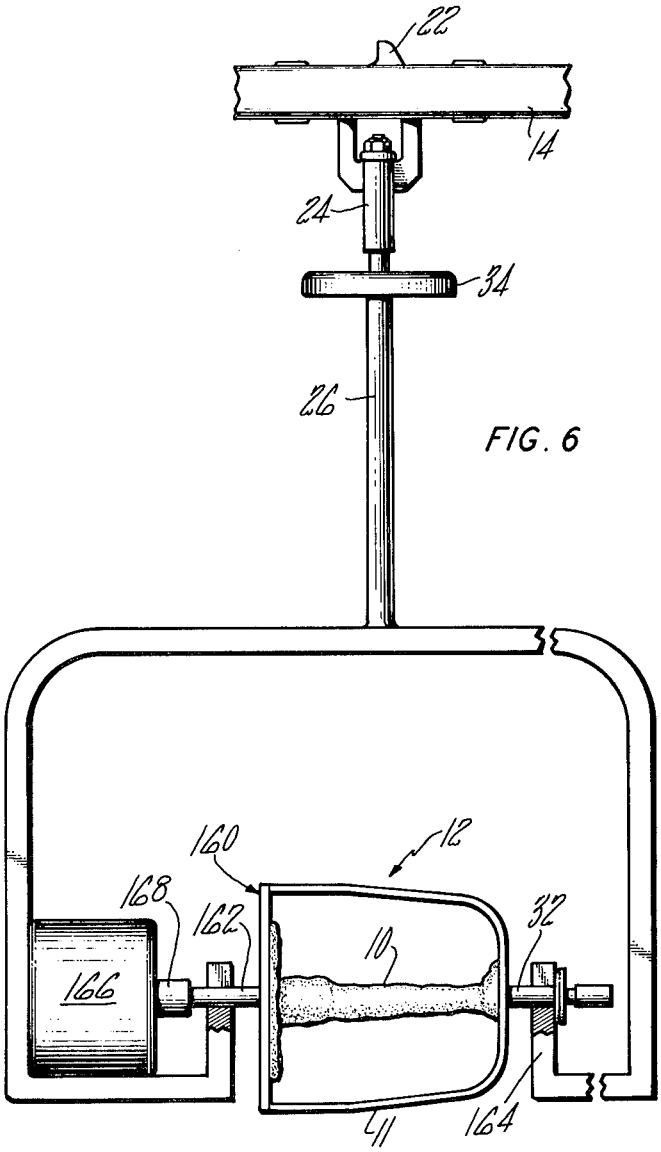
FIG. 6

WEIGHT LOSS VS. TIME FOR A GIVEN SLURRY LAYER

PATTERN TEMP. VS. TIME FOR A GIVEN SLURRY LAYER

METHOD AND APPARATUS FOR DRYING INVESTMENT CASTING MOLDS

BACKGROUND OF THE INVENTION

1. Field of the Invention

The present invention relates to the formation of investment casting molds by the lost wax process and, more particularly, to a method and apparatus for drying layers of ceramic slurry on a pattern of the article to be cast.

2. Description of the Prior Art

The lost wax process for forming investment casting molds in well known in the prior art and involves dipping an expendable pattern of the article to be cast into a slurry of ceramic particles, drying the layer of slurry on the pattern and repeating the sequence until the desired thickness for a mold wall is obtained. Oftentimes, dry particulate ceramic material is applied to the wet layer of slurry before it is dried to effect more rapid buildup of the wall. After the desired wall thickness is obtained, the pattern is removed and the ceramic layers are heated for consolidation into a strong mold to be used in casting.

Drying of the layers of ceramic slurry is one of the most critical steps in the process and is one of the most troublesome. Mold defects, such as cracking, flaking, bulging and the like, are frequently encountered and result in high mold rejection rates. The most common cause of such defects is the premature drying and consequent harmful overheating and expansion of those portions of the pattern which are easiest to dry. For example, in drying a layer of ceramic slurry on a wax pattern of a gas turbine blade or vane, it has been observed that the airfoil portion of the pattern dries much faster than the root or shroud portions and that the airfoil portion is more prone to overheating. Further, if the part is to be cast by directional solidification techniques, such as described in U.S. Pat. No. 3,260,505, wherein the mold is provided with an integral base, it has been observed that the base is one of the most difficult to dry areas of the assembly as a result of gravitational migration of moisture from the upper pattern surfaces to the base. In this case, the layer of slurry on the pattern may be adequately dried long before that on the base.

Attempts by prior art workers to limit the frequency of mold defects which originate during the drying step are exemplified by U.S. Pat. Nos. 2,932,864, 3,191,250 and 3,850,224. The drying process and apparatus of the last-cited patent appear to have been the most successful and involve conveying patterns coated with a layer of ceramic slurry through a U-shaped tunnel having two leg sections connected at one end by an impact drying section and open at the other end to a work room. High velocity drying air is directed laterally over the patterns in the impact drying section and then travels down each tunnel leg to effect further drying of the patterns therein. Drying is achieved by controlling the temperature and humidity of the air entering the impact drying section such that the wet bulb temperature is equal to the initial pattern temperature and is at least 10° F. below the dry bulb temperature. Each layer of ceramic slurry is dried in a separate tunnel, the wet bulb temperature of the drying air being held substantially constant from tunnel to tunnel while the dry bulb temperature is progressively increased. Although the process and apparatus of U.S. Pat. No. 3,850,224 and the other cited patents are improvements over the prior art, they nevertheless suffer from numerous disadvantages.

First, the drying air circulating through the tunnel is conditioned and controlled only at the entrance to the impact drying section. There is no provision for varying the temperature, humidity or velocity of the drying air after it enters the system in response to changes in the drying kinetics of the slurry layer. Also, there is no provision for ensuring that the humidity of the drying air in each section of the tunnel is uniform. As the coated patterns in the leg and impact drying sections dry and release moisture, it is possible to have drying air of different humidity in different sections of the tunnel. This lack of uniformity makes precise control over the drying process extremely difficult to achieve. Second, large patterns or clusters of multiple patterns tend to shield one another from the longitudinal airflow in the tunnel legs. This shielding inhibits even and complete drying of the patterns. Third, the exact drying time which is best for each layer of ceramic slurry cannot be achieved because all the tunnels are of the same length and the conveyor speed at each tunnel is the same. Fourth, there is no provision for adjusting the drying parameters to particular pattern shapes and sizes. Large patterns requiring long drying times and small patterns requiring much less drying time are subjected to similar drying schedules. In addition, all patterns, regardless of size and shape, are subjected to the same airflow distribution in the tunnel. No provision is made for adjusting the direction of airflow to concentrate airflow differently on different pattern shapes. These, as well as other, disadvantages severely limit the effectiveness of the prior art systems in reducing the incidence of mold defects originating during the drying step of the mold formation process.

SUMMARY OF THE INVENTION

It is an object of the present invention to provide an improved method and apparatus for drying the layers of ceramic slurry applied over patterns in the formation of investment casting molds.

It is another object of the invention to significantly reduce the incidence of cracking, flaking, bulging and other mold defects which originate during the drying step of the mold formation process.

It is another object of the invention to provide means for drying coated patterns more uniformly than has heretofore been possible.

It is still another object of the invention to improve the quality of investment casting molds while at the same time improving production rate.

The present invention may be characterized as possessing several important features, one of which is related to the discovery that, during drying, the rate of moisture removal from the slurry layer on easy to dry areas of the pattern is initially very rapid but in a short time decreases to considerably lower levels and that harmful increases in pattern temperature at these areas correspond generally with this reduction in moisture removal kinetics. One feature of the present invention is a drying process in which harmful increases in pattern temperature resulting from such a reduction in moisture removal rate are prevented by providing drying air of different quality during the different stages of moisture removal from the slurry layer. In the preferred practice of the invention, drying air having a wet bulb temperature, dry bulb temperature and velocity specially suited for rapid moisture removal from the slurry layer is initially employed in the drying process. However, after drying has progressed to the stage where harmful increases in pattern temperature are likely to occur as a result of reduced moisture removal kinetics, drying air of a different quality is employed. Generally, the drying air employed in the latter stage of the drying process will have, singly or in combination, a reduced wet bulb temperature, a reduced dry bulb temperature and increased velocity, as compared to the drying air utilized in the rapid moisture removal stage.

Another feature of the present invention is a drying system having means to optimize the time that each layer of ceramic slurry and each size and shape of pattern is dried. Still another feature of the invention is a drying system in which each coated pattern is dried with drying air whose quality and flow are unaffected by other patterns being dried in proximity thereto. A further feature of the invention is a drying system having means for concentrating flow of the drying air differently on different pattern shapes.

In a typical embodiment of the invention, patterns having a layer of ceramic slurry thereon are conveyed through a tunnel having an alternating series of individual drying and exhaust stations therein. At each drying station, drying air of controlled wet bulb and dry bulb temperatures and velocity is directed over the coated patterns transverse to their direction of advancement in the tunnel. Adjustable louvers are provided at each drying station to concentrate the flow of the drying air on those portions of the particular pattern which are most difficult to dry. After the drying air passes over the coated patterns, it is removed through the exhaust stations before it can adversely influence other drying stations in the tunnel. In accordance with the invention, drying air of a different quality is supplied to those drying stations where harmful increases in pattern temperature are likely to occur as a result of reduced moisture removal kinetics of the slurry layer. Optimum drying time for each layer of ceramic slurry is provided by proper selection of the time during which the coated patterns are progressively dried at each drying station and the number of drying stations to which the patterns are exposed.

In this and other embodiments of the invention, it may be desirable and preferred to provide means for rotating the coated patterns with their major axis in a substantially horizontal plane during progression through the tunnel. Horizontal rotation of the coated patterns greatly reduces gravitational migration of moisture on the pattern surfaces and thus improves drying uniformity and the quality of the molds produced.

Other objects, uses and advantages of the present invention will become apparent to those skilled in the art from the following drawings, description and claims.

BRIEF DESCRIPTION OF THE DRAWINGS

FIG. 5 is a fragmentary view of the conveyor and associated carrier for vertical drying.

FIG. 6 is a fragmentary view of the conveyor and associated carrier for horizontal drying.

DESCRIPTION OF THE PREFERRED EMBODIMENT

Figure 1:
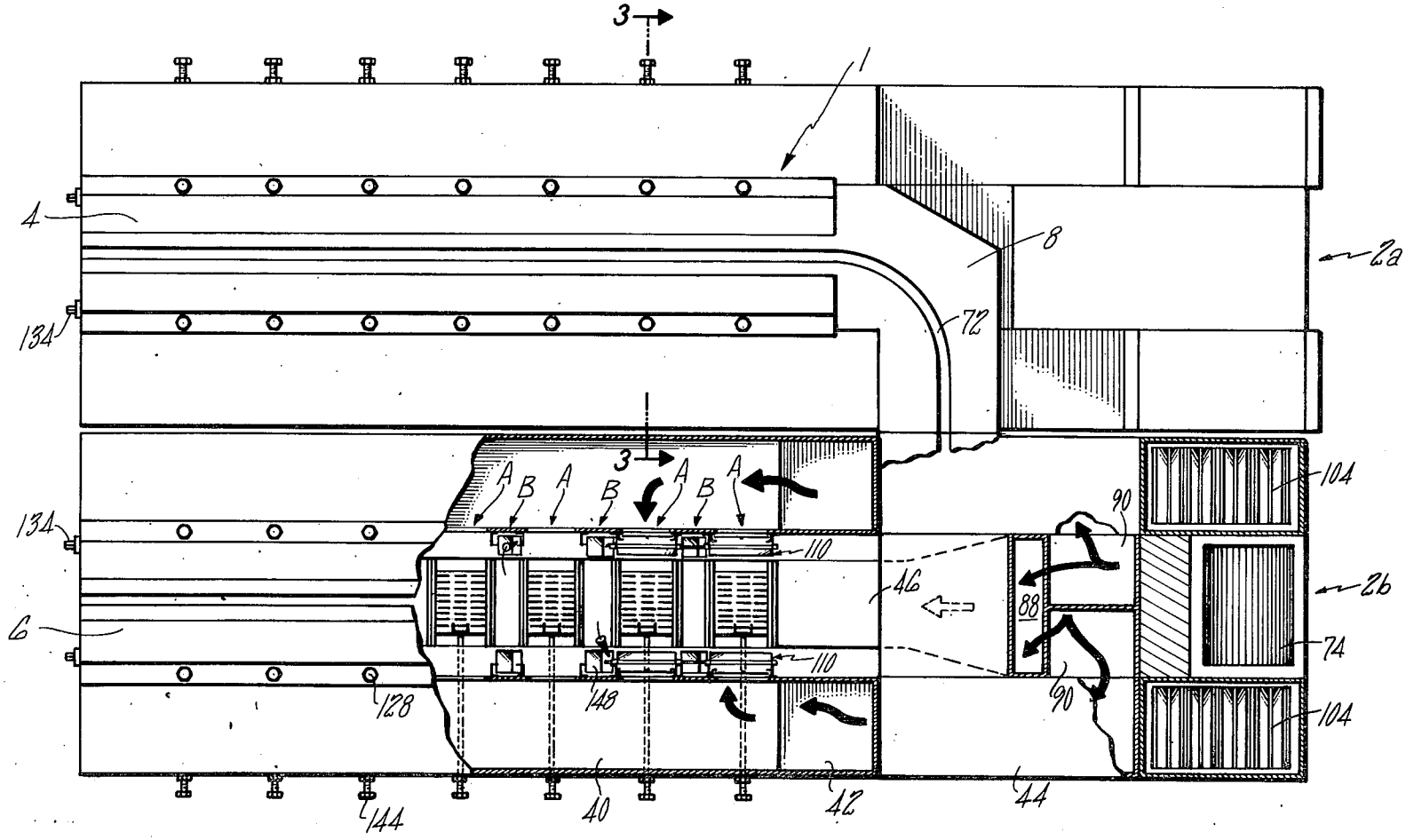
FIG. 1 is a top view of the preferred drying apparatus partly broken away and partly in section to reveal the internal structure.

A preferred apparatus for practicing the present invention is illustrated in FIGS. 1 through 5. The drying apparatus, as shown, may be used to dry one or more of the layers of ceramic slurry which are applied over the patterns during the mold formation process. Those skilled in the art will recognize that a plurality of such apparatus would normally be utilized in the mass production of investment molds, one such apparatus being employed to dry each layer of ceramic slurry applied to the patterns. Although not shown in the drawings, a dip tank containing ceramic slurry and a dusting device containing dry particulate ceramic material are generally associated with each drying apparatus.

FIG. 1 is a top view of the preferred drying apparatus with a portion broken away to reveal the internal structure. Generally, the drying apparatus comprises a U-shaped tunnel 1, an endless overhead conveyor (not shown) to transport the patterns through the tunnel and two air conditioning units 2*a* and 2*b*. The tunnel has incoming and outgoing legs 4 and 6 which open at one end to a work room where the patterns are dipped in slurry and dusted with dry ceramic particulate and which are connected at the other end by turnaround section 8. In each tunnel leg are an alternating series of drying and exhaust stations A and B which are connected to air conditioning units 2*a* and 2*b* by air supply and return conduits disposed on each side of and beneath each leg of the tunnel. The number of drying stations provided in each leg will depend on the type of patterns being dried, type of slurry applied thereto, and other factors and may be selected as desired. As the coated patterns are conveyed through the tunnel, they are progressively dried at each drying station where drying air of controlled wet bulb and dry bulb temperatures and velocity is directed over the patterns transverse to their direction of advancement in the tunnel. After the air passes over the patterns, it is removed from the tunnel by the exhaust stations disposed adjacent each of the drying stations. As shown in FIG. 1 drying air of controlled wet and dry bulb temperatures and initially controlled velocity is supplied to those drying stations in leg 4 by air conditioning unit 2*a* and to those in leg 6 by air conditioning unit 2*b*. Separate air conditioning units are utilized so that the drying air passing over the coated patterns in leg 4 can have different wet and dry bulb temperatures and velocity than that in leg 6 in accordance with the method of the invention.

Figure 3:
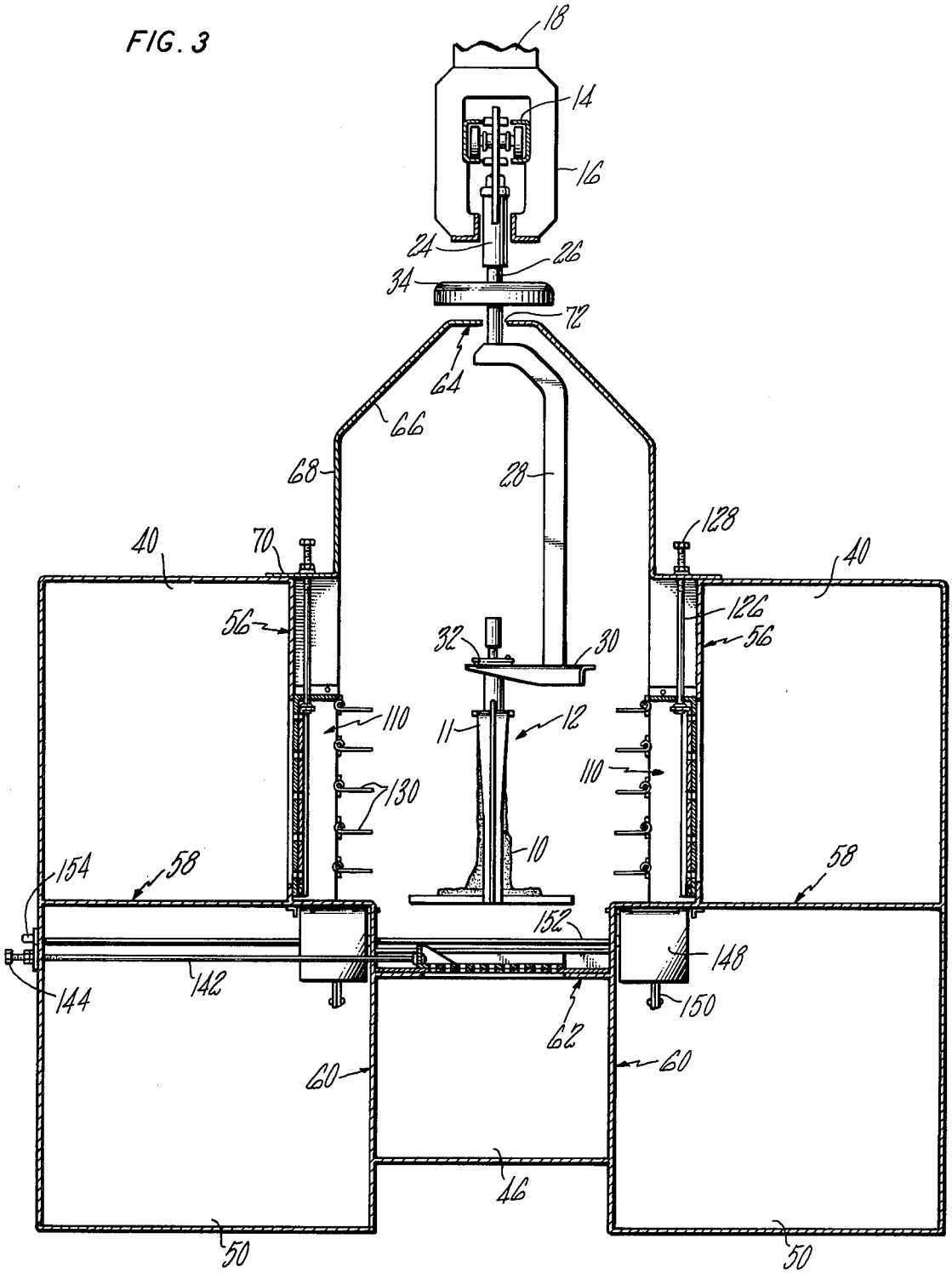
FIG. 3 is a vertical sectional view taken along line 3—3 in FIG. 1.

In the preferred practice of the invention, the patterns 10 of the article to be cast are incorporated into plastic frames 11, such as shown in FIGS. 3 and 5 and described in more detail in copending U.S. application Ser. No. 646,804, now U.S. Pat. No. 4,062,396 entitled "Method of Making a Unitary Pattern Assembly", and assigned to the assignee of the present invention. The resulting pattern assembly 12 is dipped in a tank containing ceramic slurry, dusted with dry ceramic particulate and then suspended from the endless overhead conveyor for transportation through leg 4, turnaround section 8 and leg 6 of the tunnel. Representative sections of the endless overhead conveyor are shown in FIGS. 3 and 5 as comprising a hollow metal tube 14 of rectangular cross section, the tube having longitudinal slots in the top and bottom surfaces. The tube is supported by brackets 16 from structural framework 18. Inside the tube is drive chain 20 having pairs of vertical rollers and horizontal rollers rotatably attached thereon and cog members 22 fixedly attached thereon. The vertical rollers ride on the inside bottom surface of tube 14 while horizontal rollers travel in spaced relationship in the longitudinal slots. Attached to each cog member is vertical tube 24 which is adapted to rotatably receive shaft 26. Shaft 26 extends vertically downward to carrier 28 to which it is fixedly attached. Carrier 28 is C-shaped and has base plate 30 having a slot, notch or the like suitably located therein to receive flanged handle 32 of the pattern assembly, as shown in FIG. 5. If it is desired to rotate the pattern assembly at each drying station, shaft 26 may be provided with circular member 34, which member may be rotated by suitable means, not shown, such as a moving belt or the like. By utilizing such an arrangement, the patterns may be rotated at each drying station independently of conveyor movement. The pattern assembly is moved through the U-shaped tunnel by providing suitable means, such as hydraulic ram 38, for imparting translational motion to cog members 22. The frequency with which cog members are translated will determine the time during which the pattern assemblies are dried at each drying station. This frequency may be varied as desired to suit the particular size and shape of pattern being dried. Alternatively, continuous conveyor means, which are well known in the art, may be provided to advance the pattern assemblies continuously through the tunnel at a desired speed.

As shown most clearly in FIG. 1, each tunnel leg and air conditioning unit are of the same construction. Tunnel leg 4 and air conditioning unit 2*a* are illustrated in more detail in FIGS. 2 and 3. The tunnel leg is shown as having an alternating series of drying and exhaust stations A and B which are connected to air conditioning unit 2*a* by air supply conduits 40, 42, 44, 46 and air return conduits 50 and 52 disposed on each side of and beneath the leg. The lower half of the drying tunnel is formed by walls 56 of air supply conduits 40, walls 58 and 60 of air return conduits 50 and wall 62 of air supply conduit 46. The upper half includes upper wall 64, inclined sidewalls 66 and vertical side walls 68, vertical side walls 68 being connected to the top walls of air supply conduits 40 by flanges 70. Upper wall 64 is provided with longitudinal slot 72 of sufficient width to accommodate shaft 26 of the conveyor and allow movement thereof through the U-shaped tunnel.

In operation, blower 74 forces air upwardly through vertical conduit 76 of rectangular cross section which communicates with the bottom wall of horizontal conduit 78. Horizontal conduit 78 has velocity damper 80 and humidification means 82 therein, the velocity damper being adjustable to provide initial control of the drying air velocity and the humidification means providing drying air of controlled humidity (or wet bulb temperature). The partially conditioned air then flows down vertical conduit 84 of rectangular cross section across heater 86 which heats the drying air to the desired dry bulb temperature. As seen most clearly in FIG. 1, the drying air is then split into three segments upon leaving conduit 84. One segment flows into short, vertical conduit 88 which communicates with the top wall of horizontal supply header conduit 46. The entrance to conduit 88 is provided with volume damper 89 to regulate the proportion of the air in conduit 84 which flows therein. Supply header conduit 46 is of rectangular cross section and extends under turnaround section 8 and longitudinally beneath tunnel leg 4, being centrally disposed thereunder as shown in FIG. 3. The other segments of the drying air in conduit 84 flow downwardly into vertical conduits 90 wherein deflection means (not shown) direct the air outwardly into horizontal supply conduits 44. Supply conduits 44 are located on each side of supply header conduit 46 and extend to short, vertical supply conduits 42 of rectangular cross section. The drying air flows horizontally through conduits 44 and into horizontal supply header conduits 40 which are disposed on each side of leg 4 as shown in FIG. 3. Supply header conduits 40 extend parallel to leg 4 a sufficient distance to distribute drying air to all the drying stations therein.

Figure 2:
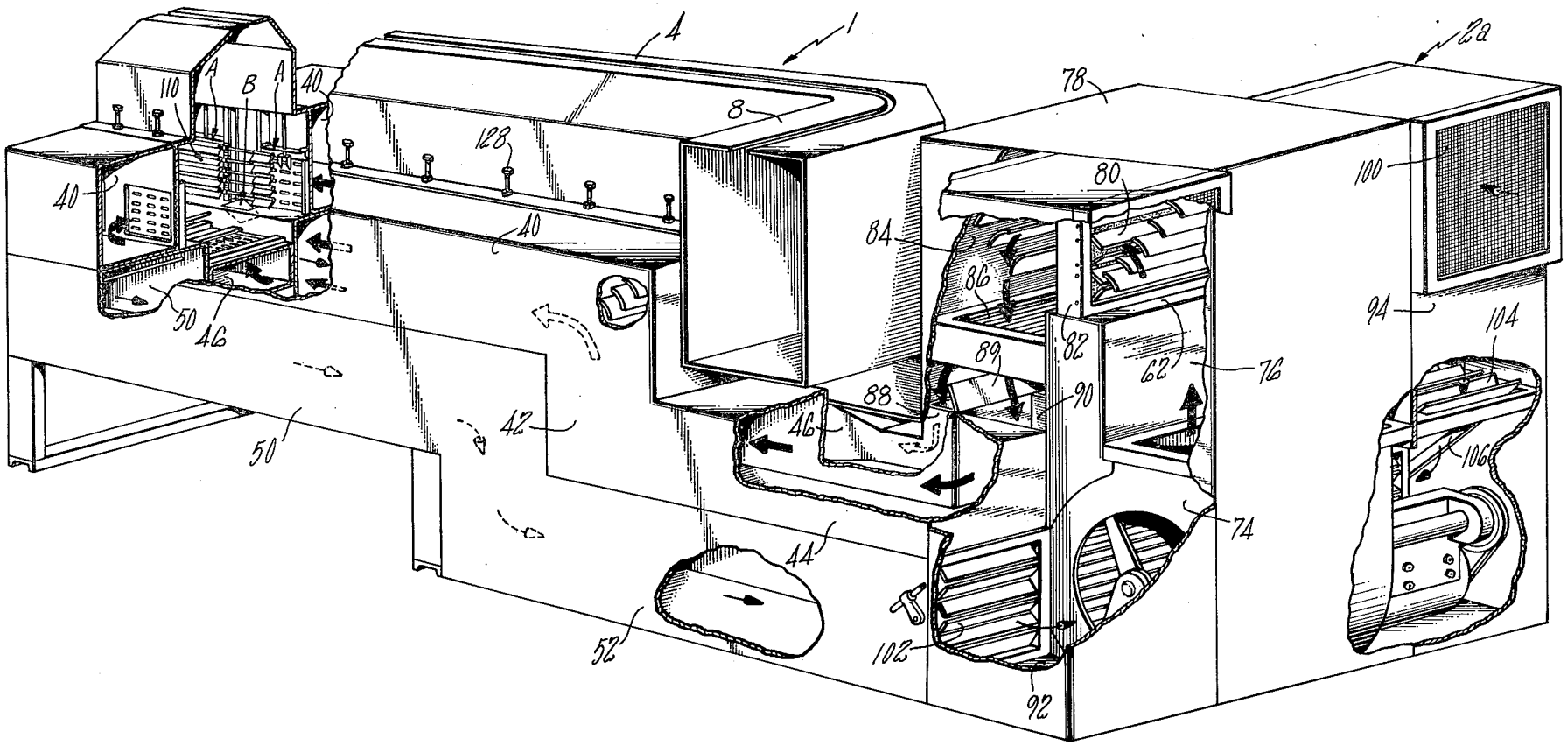
FIG. 2 is a perspective view of the incoming leg and a portion of the turnaround section of the preferred drying apparatus, partly broken away and partly in section to reveal the internal structure.

The drying air in header conduits 40 is then directed through the drying stations and over the coated pattern in tunnel leg 4, removed through the exhaust stations and collected in return header conduits 50 of rectangular cross section. Return header conduits 50 are positioned below supply header conduits 40 as shown in FIGS. 2 and 3 and direct the moisture-laden air to horizontal return conduits 52. Horizontal return conduits extend longitudinally beneath supply conduits 44 and direct the return air into plenums 92 as shown most clearly in FIG. 2. Make-up air, used to lower the relative humidity of the return air if dehumidification means are not provided in the air conditioning units, is directed into plenums 92 by vertical conduits 94 which have openings 100 to the outside atmosphere. Control dampers 102 and 104 are suitably positioned in return conduits 52 and make-up conduits 94 to regulate the proportion of return air and make-up air supplied to the plenums such that the total air supply remains essentially constant regardless of the percent make-up air added. Control dampers 102 and 104 are connected by inclined linkages 106 and horizontal linkages (not shown) so that they may be operated simultaneously to achieve proportional flow control. If make-up air is to be added to the plenums, control dampers 102 are closed and control dampers 104 are opened simultaneously by actuating linkage 106 with a conventional pneumatic damper operator, excess return air being exhausted from the tunnel through slot 72 in upper wall 64. Plenums 92 communicate with blower 74 and supply the desired mixture of return air and make-up air to each side of the blower.

Figure 4:
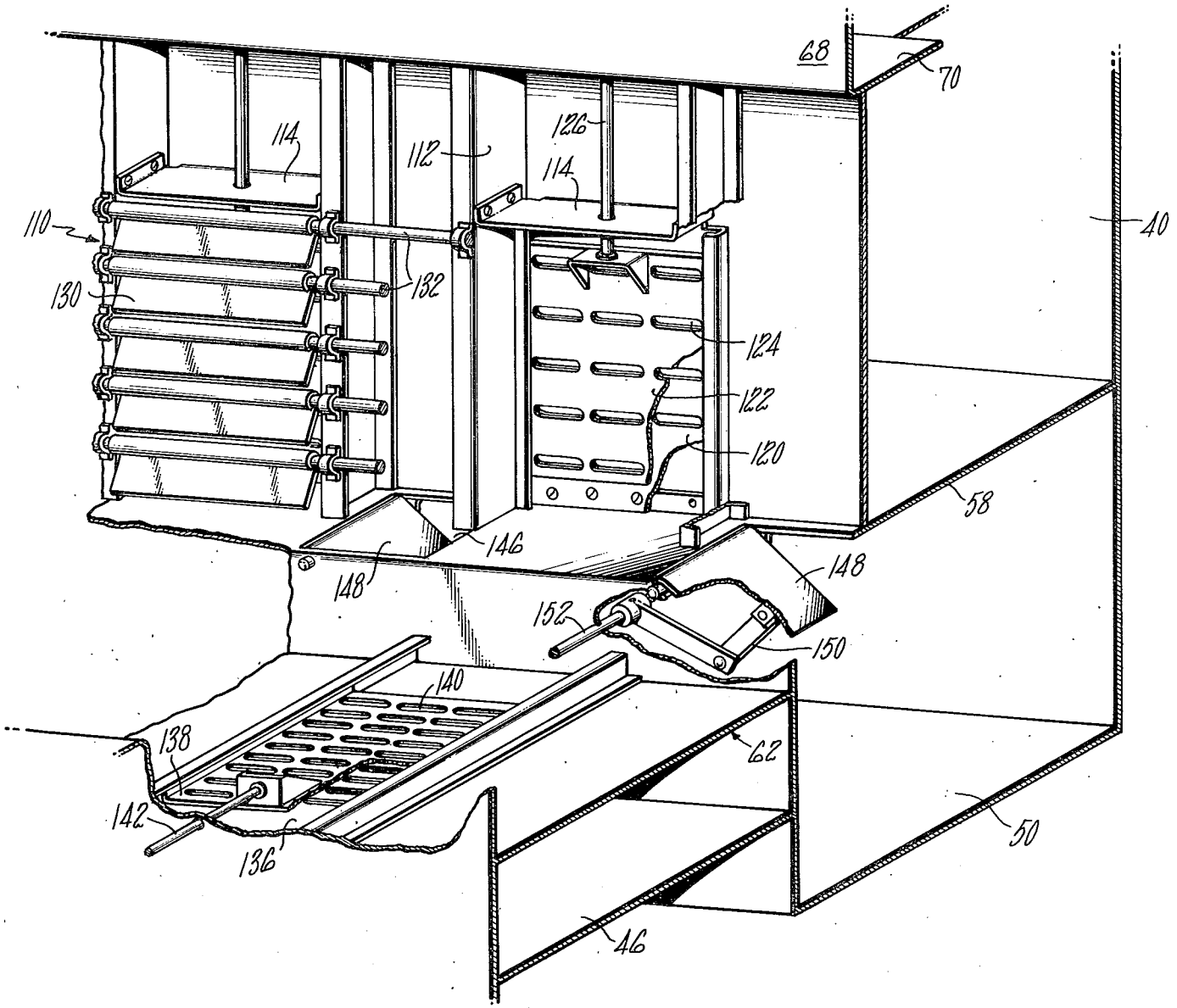
FIG. 4 is a fragmentary prespective view of the drying tunnel showing individual drying stations and exhaust stations.

As mentioned above, the drying air in supply header conduits 40 is directed over the coated patterns at each drying station. FIGS. 3 and 4 illustrate that each drying station is comprised of two horizontal conduits 110 positioned on opposite sides of the tunnel leg in an opposed relationship. The conduits 110 are defined by parallel vertical walls 112, upper horizontal wall 114 and lower horizontal wall 58 and communicate with the tunnel at the outlet end and with supply headers 40 at the inlet end. The opening into supply header 40 is covered by a velocity baffle, such as fixed, vertical plate 120 and a slidable, vertical plate 122, both of which have openings, such as spaced, parallel slots 124, therein. Plate 122 is rigidly attached to control rod 126 having handle 128. By turning handle 128, plate 122 may be moved vertically up or down relative to plate 120 to vary the slot opening and thereby provide final control of the velocity of the air in conduits 110. The velocity of the air at each drying station may be independently controlled in this manner. The combined action of plates 120 and 122 and velocity damper 80 in horizontal conduit 78 of the air conditioning unit permits the velocity of the drying air in conduits 110 to be controlled over a wide range; for example, up to about 2500 feet per minute. Preferably, the velocity of the drying air through conduits 110 is approximately twice that in supply header conduits 40 to achieve equal airflow through each drying station. If desired, airflow into a drying station may be stopped altogether by suitable movement of plate 122. In this way, the number of drying stations to which the patterns are exposed in the tunnel legs may be varied as desired. Optimum drying time for each layer of ceramic slurry and each size and shape of pattern can be provided by controlling the number of drying stations to which the patterns are exposed and the time during which the patterns are dried at each station. As shown in the figures, the conduits 110 have opposed outlet ends opening into the drying tunnel. The outlet ends are provided with a plurality of parallel adjustable louvers 130 spaced horizontally thereacross. All the adjustable louvers at a given level in the drying stations are rigidly attached to common control rods 132 which are rotatably mounted on flanges attached to walls 112. Rods 132 extend horizontally through the drying and exhaust stations and are provided with handles 134 where they protrude from the end walls of each tunnel leg as shown in FIG. 1. The angular position of the louvers can be varied from about 0° to 90° relative to vertical by turning handles 134. In the drying process, the angular position of the louvers is adjusted for each pattern shape to concentrate flow of the drying air on those portions of the pattern which are most difficult to dry. In this way, impingement of the drying air on the coated patterns can be controlled to achieve optimum moisture removal and more uniform drying of the patterns.

As explained hereinbefore, vertical conduit 88 directs air into horizontal supply header conduit 46 which extends longitudinally and centrally disposed beneath each tunnel leg, as shown most clearly in FIGS. 3 and 4. In the preferred drying apparatus of the invention, supply header 46 is provided with openings in its upper horizontal wall 62. These openings are located between the opposed outlet ends of conduits 110 and are covered by baffle plates 136 and 138, both of which have spaced, parallel slots 140 therein for controlling the velocity of the air passing therethrough. Plate 136 is fixedly attached to wall 62 of the header conduit while plate 138 is slidably mounted a short distance above plate 136. Slidable plate 138 is attached rigidly to control arm 142 having handle 144. Although not essential to the present invention, supply header conduit 46, plates 136 and 138 and their related components are desirable in the mass production of investment molds to direct air vertically against the bottom of the pattern assembly at each drying station. This insures that the slurry layer on the bottom of pattern assembly is dried and thereby prevents slurry from one dip tank from being carried into other dip tanks. If the bottom of the pattern assembly is not to be dried, the supply header conduit and associated velocity baffle plates may be removed and replaced by a flat plate to enclose the bottom of the tunnel leg between return conduits 50.

After the drying air passes over the coated patterns at each station, it is exhausted from the tunnel leg through the exhaust stations disposed adjacent the drying stations. The exhaust stations are seen most clearly in FIGS. 3 and 4 wherein it is shown that each exhaust station comprises an opening 146 of rectangular cross section disposed adjacent each of conduits 110 of each drying station, the openings being covered by damper means, such as doors 148. As illustrated in FIG. 4, the openings are located in horizontal wall 58 which forms a portion of the tunnel bottom and the doors 148 are rotatably mounted on flanges attached to said wall. The doors of each exhaust station are attached by linkages 150 to common control arm 152 having handle 154. By manipulating the handle, the doors 148 of each exhaust station may be opened to connect the interior of the tunnel to return header conduits 50. The pressure in the tunnel may be adjusted as desired by varying the extent to which the doors are open. Usually, a slight positive air pressure is maintained in the tunnel to prevent infiltration of outside air through slot 72 in upper wall 64 and through the entrance and exit ends of the tunnel. After the drying air passes over the patterns at each drying station, it is quickly exhausted from the tunnel leg through the openings 146 and collected in return header conduits 50. In this way, moisture-laden air from one drying station is prevented from interfering with the drying air of controlled quality at other stations in proximity thereto.

In the preferred apparatus illustrated herein, the blower size and configuration of the tunnel and conduits are selected such that a maximum air velocity across the patterns of about 2000 feet per minute can be attained, the velocity damper 80, plates 120 and 122 and plates 136 and 138 being in the full open position. As mentioned, under normal operating conditions, the drying air in the tunnel will have a slight positive pressure to preclude infiltration of outside air through the slot in the upper wall and through the entrance and exit ends of the tunnel. When make-up air is added to the system by simultaneously closing control dampers 102 and opening control dampers 104, excess pressure in the system is relieved through slot 72 in upper wall 64 of the tunnel.

Figure 7:
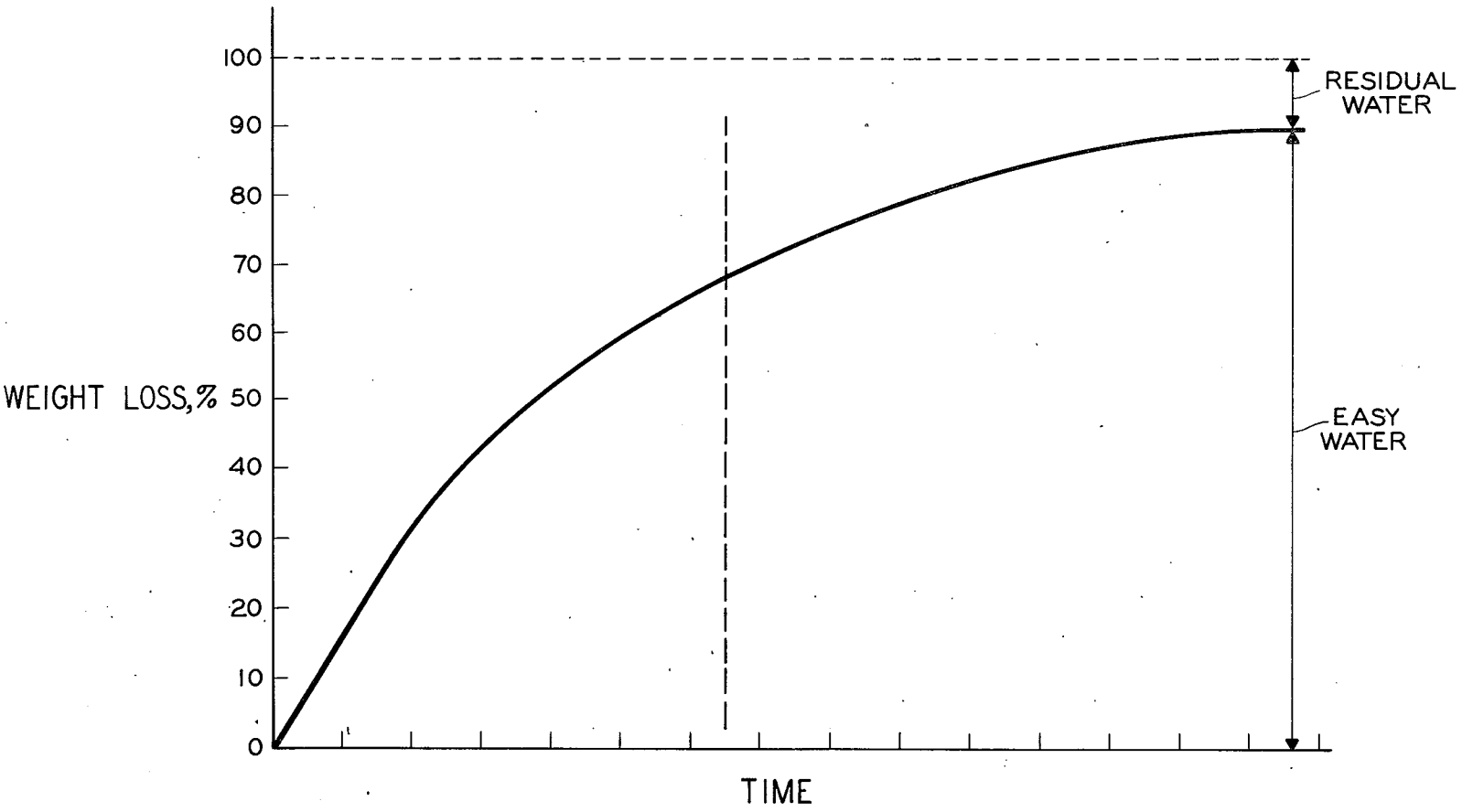
FIG. 7 is a graph of water weight loss from the slurry layer versus drying time for a conventional drying process.

The method of the present invention is a significant departure from prior art practices wherein each layer of ceramic slurry is dried in a tunnel supplied with air of one quality, i.e., air having constant wet bulb and dry bulb temperatures, during the entire drying time. In addition, in the prior art, the wet bulb temperature is maintained constant at a value equal to the initial pattern temperature. As shown in FIG. 7, under such drying conditions, the rate of moisture removal from the slurry layer on easy to dry areas of the pattern is initially very rapid but in a short time, generally 5 to 10 minutes, decreases to considerably lower levels. It has been discovered from experimental drying tests that harmful increases in pattern temperature at the easy to dry areas correspond generally with the decrease in the moisture removal kinetics of the slurry layer, as shown in FIG. 8.

Figure 8:
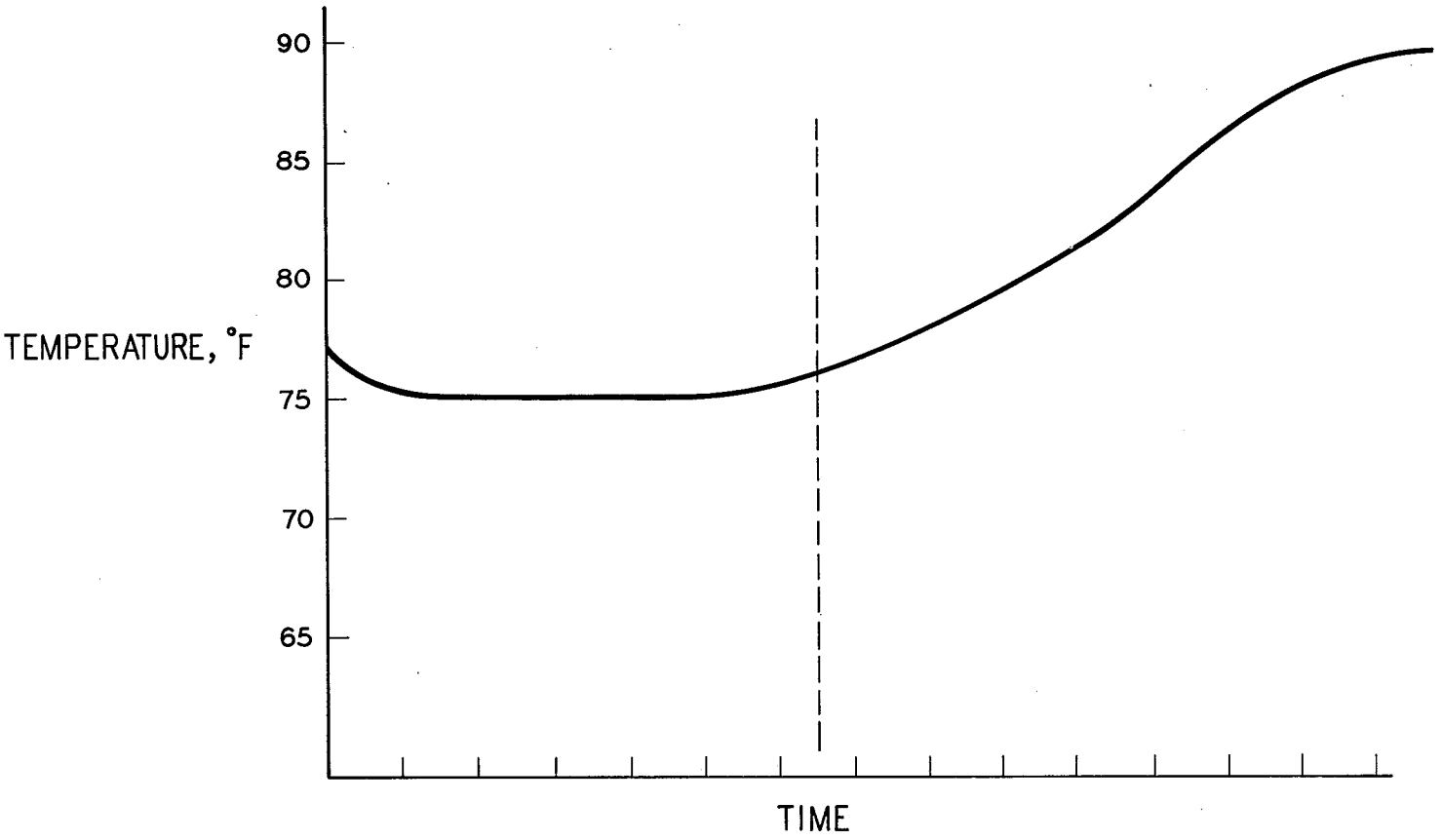
FIG. 8 is a graph of pattern temperature versus drying time for a conventional drying process.

Of course, the exact shape of the curves in FIGS. 7 and 8 will vary with such factors as the type of slurry being dried, the type of ceramic particulate applied to the slurry layer before drying, the temperature and humidity of the drying air and the like. The present invention effectively minimizes the harmful increases in pattern temperature caused by such a reduction in moisture removal kinetics during drying.

According to the invention, the temperature of the pattern is allowed to vary within critical limits during drying. The limits will of course vary with the type of pattern material being employed but, for most pattern waxes, has been found experimentally to be from about 60° F. to about 85° F. If the temperature of the wax pattern exceeds these limits, defective investment molds will normally result. Generally, in the practice of the invention, the initial temperature of the pattern is selected to be room temperature, which is usually from 75° to 85° F. In carrying out the process of the invention with the preferred apparatus illustrated herein, the coated patterns at room temperature are conveyed through the U-shaped tunnel in which the first series of 7 drying stations in leg 4 removes moisture from the slurry with air of a quality adapted to high removal rates and the second series of 7 drying stations in leg 6 removes the remaining moisture with air of a different quality, specifically adapted to prevent harmful increases in pattern temperature due to the reduction in moisture removal rate. The time during which the coated patterns are dried at each station and the number of stations to which the patterns are exposed are selected as desired to ensure that the reduction in moisture removal rate occurs near the end of the first series of drying stations or, preferably, shortly after the patterns have been conveyed therethrough. Preferably, 95 to 100% of the so-called "easy water" (see FIG. 7) of each layer is removed in the tunnel, about 65 to 75% being removed in the first series of drying stations and the remainder being removed in the second series. Attempts to remove the so-called "residual water" (see FIG. 7), which amounts to 10 to 15% of total moisture, in relatively short times, such as 15 min. -20 min., will result in severe pattern overheating. "Residual water" is therefore not removed in the drying apparatus of the present invention.

In removing moisture from the slurry layer in the first series of drying stations in leg 4, the drying air may have a quality, including wet bulb and dry bulb temperatures and velocity, customarily employed in the prior art tunnels to dry the various layers of ceramic slurry. For example, in drying the first (prime) slurry layer, a wet bulb temperature of 75° F. and a dry bulb temperature of 90° F. could be employed in combination with an air velocity across the patterns of at least 400 feet per minute. Total drying time in leg 4 would be selected to ensure that reduced moisture removal kinetics occur near the end thereof or, preferably, after the coated patterns have been conveyed therethrough. For the second and third layers of slurry, a wet bulb temperature of 75° F. and a dry bulb temperature of 95° F. could be employed in combination with an air velocity of at least 400 feet per minute. The remaining layers of slurry could be dried similarly. It should be noted that in prior art drying tunnels, the entire drying time is spent at these air qualities; in the present invention these air qualities exist only in the first series of drying stations in leg 4 where reduced moisture removal kinetics are insignificant.

Preferably, however, the quality of the drying air supplied to the first series of drying stations is substantially different from that used in the prior art. According to the invention, the wet bulb temperature of the air in the first series of drying stations is maintained substantially below the initial pattern temperature and may be in the range from about 60° F. to 70° F. This differs radically from the prior art processes wherein the wet bulb temperature of the air is kept constant during drying at a value equal to the initial pattern temperature. The dry bulb temperature is at least 10°, preferably 20°–25°, above the wet bulb temperature and is selected to provide a relative humidity in the range from 10 to 60%, preferably 30 to 50%. The velocity of the drying air passing over the patterns is then selected in the range from about 200 to 2000 feet per minute, preferably 200 to 700 feet per minute to obtain the desired drying rate. Drying time in leg 4 is selected as described above. During such nonadiabatic drying in the first series of drying stations, the temperature of the pattern, if wax, will decrease after a few minutes, e.g. 2 to 3 minutes, and tend to approach the wet bulb temperature of the drying air as a result of the pattern giving up the latent heat of vaporization. So long as the pattern temperature does not fall below about 60° F., this decrease is harmless and is actually beneficial in that it inhibits deleterious pattern heatup during drying in the first series of stations. The rate of moisture removal is very rapid in the first series of drying stations and preferably removes from 70–75% of the "easy water" from the slurry layer. The danger of pattern heat-up is minimal since drying has not progressed to the stage where the rate of moisture removal from the slurry layer has decreased sufficiently to cause harmful increases in pattern temperature.

The partially dried coated patterns are then conveyed to the second series of drying stations in leg 6 via turnaround section 8 which serves no other purpose. At the second series of drying stations, the remaining "easy water" is removed from the coated patterns with drying air of a quality different from that supplied to the first series, the quality being specifically adapted to remove the remaining "easy water" without harmful increases in pattern temperature due to reduced moisture removal kinetics. As compared to the drying air supplied to the first series of drying stations, that supplied to the second series will have, singly or in combination, a reduced wet bulb temperature, reduced dry bulb temperature or increased velocity. By suitable adjustment of these parameters in the second series of drying stations, the harmful increase in pattern temperature evident in FIG. 8 and corresponding to the reduction in the moisture removal rate in FIG. 7 can be effectively minimized, if not eliminated. Of course, the exact wet bulb and dry bulb temperatures and velocity selected for the air supplied to the second series of drying stations will depend upon the air quality at the first series, the particular slurry layer being dried and other factors. By way of example, in drying each of the first three layers of slurry in accordance with the preferred method of the invention, the air passed over the coated patterns in the first series of drying stations would have wet bulb and dry bulb temperatures of 70° F. and 85° F., respectively, and a velocity over the patterns of about 600 feet per minute. In contrast, in the second series of drying stations, the drying air could have wet bulb and dry bulb temperatures of 62° F. and 75° F., respectively, and a velocity of about 1200 feet per minute. Generally, in the second series of stations, the wet bulb temperature will be in the range from 55° to 70° F., preferably 60° to 65° F., and the dry bulb will be maintained at least 10°, preferably 20 to 25°, above the wet bulb to provide a relative humidity from 10 to 60%, preferably 30 to 50%. Velocity of the drying air across the patterns will be from about 200 to about 2000 feet per minute, preferably 700 to 1400 feet per minute.

Conventional and well-known devices may be employed to measure the wet and dry bulb temperatures of the drying air and its velocity in each series of stations. These devices (not shown) may be conveniently located, such as in conduits 110, and may be wired to a control station to automatically control velocity damper 80, humidifier 82 and heater 86. In order to continually provide drying air of 10 to 60% relative humidity during the drying process, it may be necessary to have dehumidification means incorporated in air conditioning units 2*a* and 2*b* or in conduits 94 through which make-up air is drawn or to house the entire drying apparatus in a room having such controlled humidity.

As mentioned hereinbefore, the most common cause of mold defects is the premature drying and consequent harmful overheating of certain portions of the pattern. Premature drying may oftentimes be aggravated by the fact that the patterns are dried in the vertical position. The problem is especially acute in producing investment molds for directional solidification processes wherein the mold is provided with an integral base. During the drying of such molds, water in the slurry layer migrates under gravitational force to the mold base and other horizontal platform-like areas on the pattern. Moisture migration from one surface to another promotes nonuniform drying of the pattern and results in a greater incidence of mold defects. In a preferred embodiment of the present invention, the coated patterns are rotated with their major axis in a substantially horizontal plane after being coated with the slurry layer and during their progression through the U-shaped tunnel and drying stations. Horizontal rotation of the patterns greatly reduces gravitational moisture migration and thus improves drying uniformity and the quality of molds produced.

The preferred apparatus illustrated hereinabove may be readily adapted to effect horizontal rotation of the coated patterns as shown in FIG. 6. In this embodiment, the plastic frame 11 in which the pattern is incorporated is provided with a base 160 having a cylindrical projection 162 on the bottom thereof. The projection 162 is in axial alignment with cylindrical handle 32 and is, preferably, of the same diameter. The carrier is provided with vertical members 164 which are adapted to rotatably receive projection 162 and handle 32, as shown. A small motor 166, preferably battery powered, is located near the base plate projection and has spindle 168 adapted to engage the projection and rotate the pattern assembly in the horizontal plane. The pattern is thus held with its major axis horizontally oriented and simultaneously rotated about said axis as it progresses through the tunnel.

Figure 9:
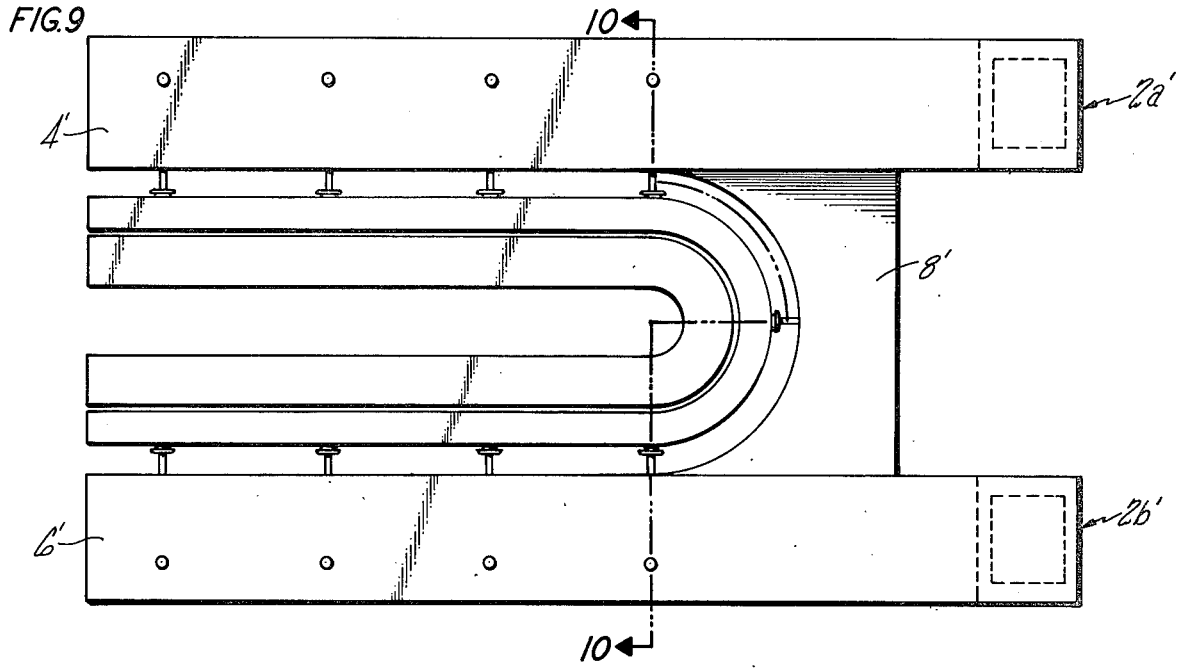
FIG. 9 is a top view of a drying apparatus especially adapted for horizontal drying.
Figure 10:
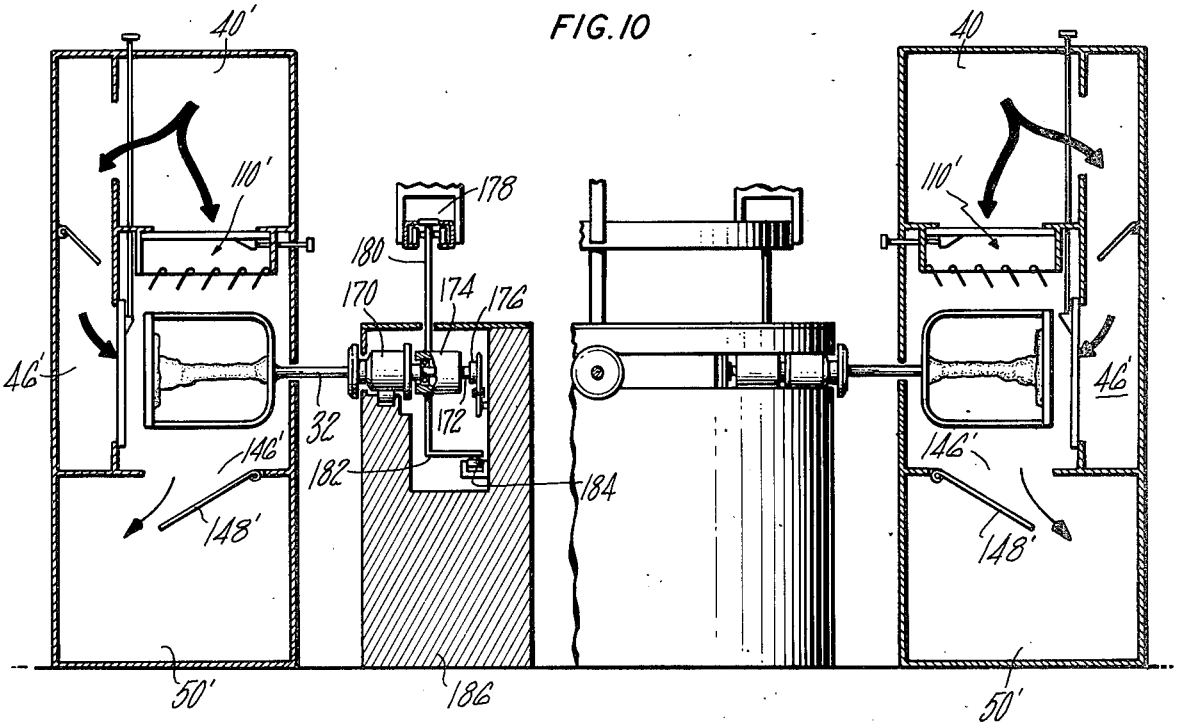
FIG. 10 is a sectional view taken along line 10—10 in FIG. 9.

Alternatively, a drying apparatus especially designed for horizontal drying of the patterns in accordance with the invention may be utilized. One such embodiment is illustrated in FIGS. 9 and 10. It includes the same general components as the preferred drying apparatus described in detail above, including a U-shaped tunnel having incoming and outgoing legs 4' and 6' which are connected to air conditioning units 2*a'* and 2*b'* by air supply and return conduits. An endless conveyor is provided to convey the patterns through the tunnel while simultaneously rotating them with their major axis in the horizontal plane.

The conveyor is positioned with the "U" formed by the tunnel legs and the turnaround section. The handle 32 of the pattern assembly is gripped by a chuck 170 which is mounted on horizontal shaft 172 extending rotatably through housing 174. The end of shaft 172 opposite the chuck has roller 176 attached thereto. The roller is driven by conventional means, such as a moving belt or the like, to impart continuous horizontal rotation to the pattern. The patterns are conveyed through the tunnel by overhead conveyor 178 which is connected to the housing by arm 180. To maintain proper positioning of the housing, L-shaped bracket 182 is attached thereto, the bracket having a roller 184 positioned thereon to travel in a locating slot projecting from support structure 186.

In operation, air conditioning units 2*a'* and 2*b'* supply conditioned drying air to the drying stations in tunnel legs 4' and 6', respectively, through air supply headers 40' disposed above the tunnel. Each drying station is comprised of one vertical conduit 110' opening into the tunnel at its lower end and into air supply header 40' at the top end. The opening into the supply conduit is covered by fixed and slidable plates, both of which have spaced, parallel slots therein and the opening into the tunnel is covered by adjustable louvers, these components functioning as described above with regard to the preferred drying apparatus. The apparatus may also include air supply headers 46' and associated components for drying the bottom of the pattern assemblies as they progress from one drying station to another in the tunnel.

After the drying air passes over the patterns, it is removed from the tunnel through exhaust stations disposed in opposed relation to the drying stations. Each exhaust station includes an opening 146' connecting the tunnel leg to air return header 50', the opening being oppositely disposed from the outlet end of conduit 110'. The opening is covered by door 148' rotatably mounted on the top wall of return header 50' as shown. The moisture-laden air at the drying stations passes through the openings, is collected in the return headers and is then carried beneath the drying tunnels to a plenum in the air conditioning units, where the return air may be mixed with make-up air. The desired air mixture is then fed into the blowers and passed through the velocity dampers, humidification means and heating means as described hereinabove with reference to the preferred drying apparatus.

Of course, those skilled in the art will recognize that the present invention may be practiced in numerous other ways. For example, individual drying stations, each supplied with drying air of a different quality by individual air conditioning units is within the scope of the invention. In such an embodiment, a drying tunnel to enclose all the drying stations may not be necessary. Also, instead of being conveyed through a U-shaped tunnel, the coated patterns may be transported through one longitudinal tunnel in which several series of drying stations are disposed, each series being supplied drying air of a different quality. In addition to those disclosed, various other configurations and orientations of drying stations and exhaust stations may be utilized to practice the present invention.

Having thus described typical embodiments of our invention, that which we claim as new and desire to secure by Letters Patent of the United States is:

1. In the formation of investment casting molds, a method for drying a layer of ceramic slurry which has been applied to patterns of the article to be cast comprising the steps of:

(a) conveying the coated patterns through a series of individual drying stations;

(b) directing drying air of controlled quality, including controlled wet bulb temperature, dry bulb temperature and velocity, across the patterns at a sufficient number of stations to effect drying including:

(1) initially employing drying air of a quality especially suited to effect rapid removal of a majority of the moisture from the slurry layer, said drying air having a wet bulb temperature about equal to the initial pattern temperature, a dry bulb temperature at least 10° above the wet bulb temperature and a velocity across the patterns of at least 400 feet per minute, said drying air being employed until harmful increases in pattern temperature are likely to occur as a result of a reduction in the kinetics of moisture removal from the slurry layer; (2) then employing drying air of a different quality to remove the remaining moisture from the layer, the quality of said air being specially adapted to prevent harmful increases in pattern temperature due to the reduced moisture removal kinetics of the layer and differing from that used in initial drying by having, singly or in combination, a reduced wet bulb temperature, reduced dry bulb temperature and increased velocity;

(c) exhausting the drying air in the vicinity of each drying station after said air passes over the coated patterns and before said air adversely affects drying air of controlled quality at other stations.

2. The method of claim 1 wherein the drying air is directed across the patterns transverse to their direction of advancement through the drying stations.

3. The method of claim 1 wherein the coated patterns are dried with their major axis in a substantially vertical plane.

4. The method of claim 3 wherein the coated patterns are rotated about said axis at each drying station.

5. The method of claim 1 wherein the coated patterns are conveyed through the series of drying stations with their major axis horizontally oriented, said patterns being simultaneously rotated about said axis to minimize gravitational migration of moisture.

6. The method of claim 1 wherein the drying air at each station is directed preferentially on those portions of the patterns which are most difficult to dry.

7. In the formation of investment casting molds, a method for drying a layer of ceramic slurry which has been applied to wax patterns of the article to be cast comprising the steps of:

(a) conveying the coated patterns through a series of individual drying stations;

(b) directing drying air of controlled quality including wet bulb temperature, dry bulb temperature and velocity, across the patterns at a sufficient number of stations to effect drying, the temperature of the wax patterns being allowed to vary from about 60° F. to about 85° F. during drying, including:

(1) initially employing drying air having a wet bulb temperature substantially below the initial pattern temperature and in the range from about 60° F. to about 70° F., a dry bulb temperature at least 10° F. above the wet bulb temperature to provide a relative humidity from about 10% to about 60% and a velocity across the patterns from about 200 to about 2000 feet per minute, to effect rapid removal of a majority of the moisture from the slurry layer, said drying air being employed until harmful increases in pattern temperature are likely to occur as a result of a reduction in the kinetics of moisture removal from the slurry layer;

(2) then employing drying air of a different quality to remove the remaining moisture from the layer, the quality of said air being specially adapted to prevent harmful increases in pattern temperature as a result of the reduced moisture removal kinetics and differing from the drying air used in initial drying by having, singly or in combination, a reduced wet bulb temperature, reduced dry bulb temperature and increased velocity, including a wet bulb temperature from about 55° F. to about 70° F., a dry bulb temperature at least 10° F. above the wet bulb temperature to provide a relative humidity from about 10% to about 60% and a velocity across the patterns from about 200 to 2000 feet per minute;

(c) exhausting the drying air in the vicinity of each drying station after said air passes over the coated patterns and before said air adversely affects the drying air at other stations.

8. The method of claim 7 wherein the drying air initially employed has a wet bulb temperature from about 62° F. to about 68° F.

9. The method of claim 7 wherein the drying air initially employed has a dry bulb temperature at least 20° F. above the wet bulb temperature to provide a relative humidity from about 30% to about 50%.

10. The method of claim 7 wherein the drying air initially employed has a velocity across the patterns from about 200 to about 700 feet per minute.

11. The method of claim 7 wherein the drying air employed to remove the remaining moisture has a wet bulb temperature from about 60° F. to about 65° F.

12. The method of claim 7 wherein the drying air employed to remove the remaining moisture has a dry bulb temperature at least 20° F. above the wet bulb temperature to provide a relative humidity from about 30% to about 50%.

13. The method of claim 7 wherein the drying air employed to remove the remaining moisture has a velocity across the patterns from about 700 to about 1400 feet per minute.

* * * * *